US008820410B2

(12) United States Patent
Parks et al.

(10) Patent No.: US 8,820,410 B2
(45) Date of Patent: Sep. 2, 2014

(54) CONTROL SYSTEM FOR BLOWOUT PREVENTER STACK

(75) Inventors: William C. Parks, Utopia, TX (US); Dana C. Beebe, Houston, TX (US); Chester W. Kronke, Houston, TX (US)

(73) Assignee: DTC International, Inc., Houston, TX (US)

( * ) Notice: Subject to any disclaimer, the term of this patent is extended or adjusted under 35 U.S.C. 154(b) by 1152 days.

(21) Appl. No.: 12/189,701

(22) Filed: Aug. 11, 2008

(65) Prior Publication Data

US 2009/0194290 A1 Aug. 6, 2009

Related U.S. Application Data

(60) Provisional application No. 60/954,919, filed on Aug. 9, 2007, provisional application No. 60/955,085, filed on Aug. 10, 2007.

(51) Int. Cl.

| | |
|---|---|
| ***E21B 43/013*** | (2006.01) |
| ***E21B 33/035*** | (2006.01) |
| ***E21B 41/00*** | (2006.01) |
| ***E21B 33/038*** | (2006.01) |

(52) U.S. Cl.

CPC ..... *E21B 33/0355* (2013.01)
USPC ..... 166/339; 166/340; 166/350; 166/363; 166/364; 166/368

(58) Field of Classification Search

CPC ..... E21B 33/0355
USPC ..... 166/338, 363, 368, 344, 373; 251/1.1, 251/1.3, 30.01
See application file for complete search history.

(56) References Cited

U.S. PATENT DOCUMENTS

| | | | | |
|---|---|---|---|---|
| 3,496,999 | A | 2/1970 | Rowley | |
| 4,607,701 | A | 8/1986 | Gunderson | |
| 4,637,470 | A | 1/1987 | Weathers | |
| 6,032,742 | A * | 3/2000 | Tomlin et al. | 166/345 |
| 6,161,618 | A | 12/2000 | Parks | |
| 6,484,806 | B2 * | 11/2002 | Childers et al. | 166/351 |
| 6,622,799 | B2 * | 9/2003 | Dean | 166/381 |
| 6,644,410 | B1 * | 11/2003 | Lindsey-Curran et al. | 166/360 |
| 6,907,932 | B2 | 6/2005 | Reimert | |
| 6,938,695 | B2 | 9/2005 | Williams | |
| 7,216,714 | B2 | 5/2007 | Reynolds | |
| 2006/0037758 | A1 * | 2/2006 | Reynolds | 166/368 |
| 2008/0302536 | A1 * | 12/2008 | Kotrla et al. | 166/341 |
| 2010/0243260 | A1 * | 9/2010 | Donohue et al. | 166/344 |

* cited by examiner

*Primary Examiner* — James Sayre
(74) *Attorney, Agent, or Firm* — James J. Murphy; Thompson & Knight LLP

(57) ABSTRACT

A modular control system consisting of multiple, remotely retrievable functional modules for controlling a blowout preventer stack. The various functional modules can be located on the lower marine riser package and blowout preventer stack positioned near the equipment with which they are associated, wherein this distribution of modules nearly eliminates the complex interface connection between the lower marine riser package and blowout preventer stack. Each of the functional modules is capable of being installed, retrieved or replaced with a single remotely operated vehicle (ROV) deployment from a vessel. The functional modules can be used to operate as a complete control system for a blowout preventer stack or can be used selectively individually or in various combinations to accommodate multiple control applications or upgrades of other control systems.

22 Claims, 2 Drawing Sheets

CONTROL SYSTEM FOR BLOWOUT PREVENTER STACK

CROSS REFERENCE TO RELATED APPLICATIONS

This application claims priority to U.S. Provisional Patent Application No. 60/955,085, entitled "Control System for Blowout Preventer Stack", filed on Aug. 10, 2007, and U.S. Provisional Patent Application No. 60/954,919, entitled "Control Module for Subsea Equipment", filed on Aug. 9, 2007, each of which are incorporated herein by reference in their entirety.

FIELD OF THE INVENTION

This invention relates in general to subsea well drilling and in particular to a control system for controlling a blowout preventer stack connected between the subsea wellhead assembly and a riser.

BACKGROUND OF THE INVENTION

Subsea Control Modules (SCMs) are commonly used to provide well control functions during the production phase of subsea oil and gas production. Typical well control functions and monitoring provided by the SCM can include: 1) actuation of fail-safe return production tree actuators and downhole safety valves; 2) actuation of flow control choke valves, shut-off valves, etc.; 3) actuation of manifold diverter valves, shut-off valves, etc.; 4) actuation of chemical injection valves; 5) actuation and monitoring of Surface Controlled Reservoir Analysis and Monitoring Systems (SCRAMS) sliding sleeve, choke valves; 6) monitoring of downhole pressure, temperature and flow rates; and 7) monitoring of sand probes, production tree and manifold pressures, temperatures, and choke positions.

The close proximity of the typical SCM to the subsea production tree, coupled with its electro-hydraulic design allows for quick response times of tree valve actuations. The typical SCM receives electrical power, communication signals and hydraulic power supplies from surface control equipment. The subsea control module and production tree are generally located in a remote location relative to the surface control equipment. Redundant supplies of communication signals, electrical, and hydraulic power are transmitted through umbilical hoses and cables of various length, linking surface equipment to subsea equipment. Electronics equipment located inside the SCM conditions electrical power, processes communications signals, transmits status and distributes power to devices such as solenoid piloting valves, pressure transducers and temperature transducers.

Low flow rate solenoid piloting valves are typically used to pilot high flow rate control valves. These control valves transmit hydraulic power to end devices such as subsea production tree valve actuators, choke valves and downhole safety valves. The status condition of control valves and their end devices are read by pressure transducers located on the output circuit of the control valves. Auxiliary equipment inside the typical SCM consists of hydraulic accumulators for hydraulic power storage, hydraulic filters for the reduction of fluid particulates, electronics vessels, and a pressure/temperature compensation system.

Recognized by the inventors is that the application of production control system technology incorporated into a modular approach to drilling control systems can allow for additional redundancy, can enhance survivability during deployment, operation, and retrieval, and can reduce maintenance repair times and costs, along with many other benefits.

SUMMARY OF THE INVENTION

For drilling applications a subsea blowout preventer assembly is provided. The assembly includes a lower marine riser package (LMRP) and a blowout preventer stack (BPS). The LMRP includes a first junction plate and said BPS includes a second junction plate. The junction plates connect at least one of hydraulic, electrical or communications signal from the LMRP to the BPS. The assembly includes at least one LMRP module baseplate positioned on the LMRP and at least one LMRP control module configured to control electrical or hydraulic functionality associated with the LMRP. The LMRP control module is releasably connected to the LMRP module baseplate. The assembly also includes at least one BPS module baseplate positioned on the BPS and at least one BPS control module configured to control electrical and/or hydraulic functionality associated with said BPS. The BPS module is releasably connected to the BPS module baseplate. The LMRP and BPS modules are configured to be installed and retrieved by a remotely operated vehicle.

In certain embodiments, the overall assembly control systems are redundant, wherein two or more of the LMRP control modules are present on the LMRP and two or more of the BPS control modules are present on the BPS, thereby forming redundant assembly control modules. In certain embodiments, the redundant LMRP modules do not function cooperatively and the redundant BPS modules do not function cooperatively.

In certain embodiments, the LMRP module baseplate can also include at least one auxiliary LMRP module selected from the group consisting of a subsea regulator module, subsea valve module, subsea filter module, subsea accessory module, c subsea shuttle valve module, subsea acoustic system module, subsea pressure transducer module and subsea temperature transducer module. In certain embodiments, the BPS module baseplate also includes at least one auxiliary BPS module selected from the group consisting of a subsea regulator module, subsea valve module, subsea filter module, subsea accessory module, subsea shuttle valve module, subsea acoustic system module, subsea pressure transducer module and subsea temperature transducer module.

In certain embodiments, the assembly also includes a parking base plate positioned on the LMRP or the BPS, said parking base plate comprising at least two parking receptacles adapted to receive any of said modules.

In another aspect, a subsea blowout preventer assembly is provided that includes a lower marine riser package (LMRP) and a blowout preventer stack (BPS), wherein the LMRP includes a first junction plate and the BPS includes a second junction plate. The junction plates connect at least one of the hydraulic, electrical or communications signals from the LMRP to the BPS. Additionally, the assembly includes at least one LMRP module baseplate positioned on the LMRP and at least one releasably connected LMRP control module configured to control electrical or hydraulic functionality associated with the LMRP. Additionally, the assembly includes at least one auxiliary LMRP module selected from the group consisting of a subsea regulator module, subsea valve module, subsea filter module, subsea accessory module, subsea shuttle valve module, subsea acoustic system module, subsea pressure transducer module and subsea temperature transducer module. The assembly also includes at least one BPS module baseplate positioned on said BPS and at least one releasably connected BPS control module configured to control electrical or hydraulic functionality associated with the BPS. In addition, the assembly includes at least one auxiliary BPS module selected from the group consisting of a subsea regulator module, subsea valve module, subsea filter module, subsea accessory module, subsea shuttle valve module, subsea acoustic system module, subsea pressure transducer module and subsea temperature transducer module. The modules are configured to be installed and retrieved by a remotely operated vehicle.

In another aspect, a method for controlling a subsea blowout preventer assembly is provided, wherein the assembly includes a lower marine riser package (LMRP) and a blowout preventer stack (BPS). The LMRP includes a first junction plate and said BPS includes a second junction plate. The LMRP and BPS are coupled at said first and second junction plates, and the junction plates connect at least one of hydraulic, electrical or communication signal from the surface to the assembly. The method includes the steps of providing at least one LMRP module baseplate positioned on the LMRP and providing at least one LMRP control module releasably connected to the LMRP module baseplate configured to control electrical or hydraulic functionality associated with the LMRP. The method also includes the steps of providing at least one auxiliary LMRP module selected from the group consisting of a subsea regulator module, subsea valve module, subsea filter module, subsea accessory module, subsea shuttle valve module, subsea acoustic system module, subsea pressure transducer module and subsea temperature transducer module, said auxiliary LMRP module being releasably connected to the LMRP module baseplate. At least one BPS module baseplate positioned on said BPS is provided; and at least one BPS control module releasably connected to the BPS module baseplate and configured to control electrical or hydraulic functionality associated with said BPS is provided. Additionally, the method includes providing at least one auxiliary BPS module selected from the group consisting of a subsea regulator module, subsea valve module, subsea filter module, subsea accessory module, subsea shuttle valve module, subsea acoustic system module, subsea pressure transducer module and subsea temperature transducer module, said auxiliary BPS module being releasably connected to the BPS module baseplate. Finally, the method includes the steps of installing or removing at least one module selected from the group consisting of the LMRP control module, the LMRP auxiliary module, the BPS control module, and the BPS auxiliary module with a remotely operated vehicle (ROV).

In another aspect, a method for replacing a module on a subsea blowout preventer assembly, the assembly including a lower marine riser package (LMRP) and a blowout preventer stack (BPS), wherein the LMRP includes at least one LMRP module baseplate and the BPS includes at least one BPS module baseplate. The LMRP module baseplate is configured to receive at least one LMRP module and the BPS module baseplate is configured to receive at least one BPS module. The LMRP and said BPS each include at least one parking receptacle. The method for replacing includes the steps of: utilizing a remotely operated vehicle (ROV) to transport at least one replacement module from the surface to a module baseplate, positioning said replacement module in a first parking receptacle adapted to receive a module, and utilizing the ROV to remove at least one module from either the LMRP module baseplate or said BPS module baseplate, thereby creating an empty position in the module baseplate. The method further includes utilizing the ROV to position the removed module in a second parking receptacle adapted to receive a module and utilizing the ROV to retrieve the replacement module from the first parking receptacle and position said replacement module into the empty position in the module baseplate.

DETAILED DESCRIPTION OF THE INVENTION

Figure 1:
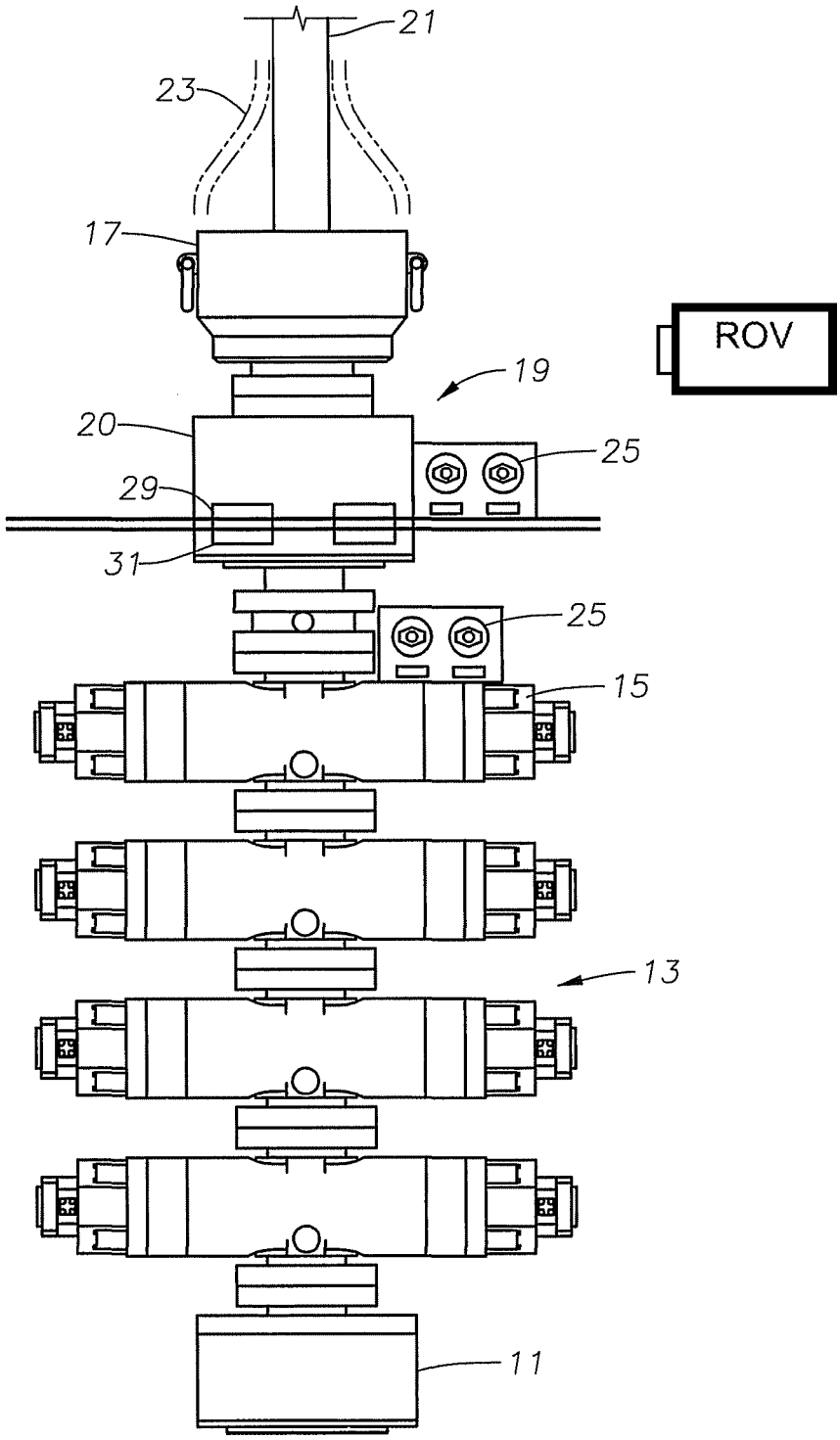
FIG. 1 is a schematic view illustrating a lower marine riser package connected to a blowout preventer stack in accordance with this invention.

Referring to FIG. 1, a subsea well is shown in the process of being drilled. The subsea well includes a subsea wellhead assembly located at the sea floor. A blowout preventer (BOP) stack 13 secures to the subsea wellhead assembly by means of a hydraulically actuated connector 11. BOP stack 13 is a complex device for controlling pressure in the well. BOP stack 13 will have a number of rams 15, some of which can close on or around drill pipe or casing. Other rams 15 can shear pipe to form a complete closure in the event of an emergency.

BOP stack 13 is connected to a lower marine riser package (LMRP) 19. LMRP 19 includes a connector 20 that is hydraulically actuated for connecting to BOP stack 13. As shown in FIG. 1, an annular blowout preventer (BOP) 17 can be a part of LMRP 19 and mounts on top of connector 20 for closing around pipe. Alternately, annular BOP 17 can be part of BOP stack 13 and not part of LMRP 19; or both BOP stack 13 and LMRP 19 can include an annular BOP 17. LMRP 19 is connected to the lower end of a drilling riser 21. Drilling riser 21 includes a large diameter central pipe through which drilling tools can be lowered. A number of auxiliary or rigid conduits 23 can be spaced around the central pipe for delivering hydraulic fluid and for other functions. Additionally, an electrical cable that can include a bundle of wires, and optionally includes fiber optic lines for providing communications and electrical power, extends alongside riser 21 from a drilling vessel at the surface. LMRP 19 and BOP stack 13 includes one or more modules 25 that are adaptable to perform many functions, including the control of the LMRP or BOP stack.

All modules 25 of both the LMRP and the BOP stack are installable and are retrievable by remotely operated vehicle (ROV). LMRP 19 can include a number of retrievable modules 25 that are releasably mounted to it. Similarly, BOP stack 13 can include a number of retrieval modules 25 that are releasably mounted to it. Each module 25 is sufficiently small and lightweight that it can be installed and retrieved using a ROV. Modules 25 on LMRP 19 can control various functions on LMRP 19 and modules 25 on BOP stack 13 can control various functions on BOP stack 13. Modules 25 can be placed near the functionality that they control and/or with which they are associated, in contrast to prior art control devices associated with the control of a BOP stack, which are generally large and are located relatively distant from the functionality with which they are associated, and normally on the LMRP.

In being remotely retrievable, the replacement of one or more modules can be accomplished with a remotely operable vehicle, which can thereby eliminate the need to pull the entire apparatus, including the LMRP. Use of the ROV during maintenance operations results in reduced downtime and increased savings.

LMRP 19 includes at least one junction plate 29, and in certain embodiments, two junction plates, that stab into mating engagement with mating junction plates 31 on BOP stack 13 when LMRP 19 is connected to BOP stack 13. Junction plates 29, 31 connect hydraulic, electrical, and/or fiber optic lines for supplying hydraulic fluid pressure, electrical power and communications to and from the LMRP 19 to BOP stack 13.

Exemplary modules can include: subsea control modules, subsea regulator modules, subsea valve modules, subsea filter modules, subsea shuttle (valve) modules, and subsea accessory modules, in addition to modules that control or are associated with subsea chemical injection, subsea choke inserts, subsea acoustic systems, subsea pressure and/or temperature transducers.

Figures 2A, 2B:
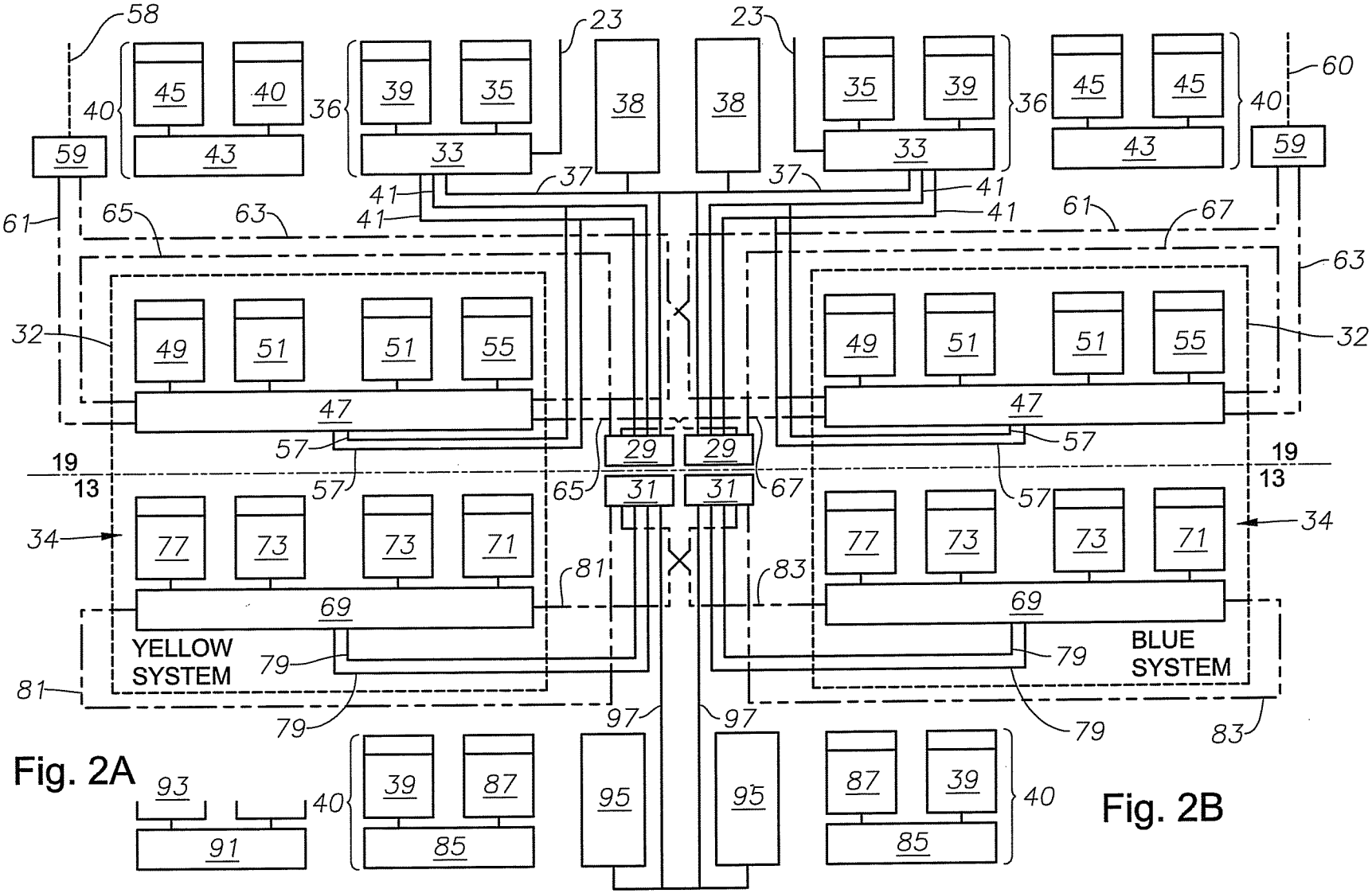
FIGS. 2A and 2B are a schematic of a subsea control system for the lower marine riser package and the blowout preventer of FIG. 1.

An example of several of the exemplary modules 25 and the functions they control are illustrated in FIGS. 2A and 2B. The overall control system is redundant, with the modules 25 shown in FIG. 2A, arbitrarily marked as "Yellow System", being duplicated by the modules 25 shown in FIG. 2B and arbitrarily marked as "Blue System". For convenience, the same references numerals are used for each system in most instances. The Yellow System can perform all functions of LMRP 19 and BOP stack 13 without requiring the input from the Blue System, and similarly the Blue System can perform all functions of LMRP 19 and BOP stack 13 without requiring the input from the Yellow System. In certain embodiments, the Yellow and Blue Systems are not operated at the same time. A control module 25 of the Yellow System is not typically operated with the Blue System and vice versa. An exception to this can be found in embodiments wherein the conduit valve package 36 may be operated by either Yellow or Blue Systems. Similarly, in certain embodiments, the control modules 25 mounted to LMRP 19 only control functions of LMRP 19, and do not control the functions of BOP stack 13 and vice versa.

LMRP 19 may include singular or redundant hydraulic fluid supply equipment for both the modules 25 of LMRP 19 and for the modules 25 of BOP stack 13. The hydraulic fluid supply equipment includes a base plate 33 on the Yellow System (FIG. 2A) and a base plate on the Blue System (FIG. 2B), wherein the base plates 33 can include receptacles and couplings for supporting at least one filter module 35. Filter module 35, like all of the other modules 25, can be sufficiently small and lightweight so as to be installed and retrieved by an ROV. Each filter module 35 can include high flow rate filters designed to provide for local filtration of hydraulic fluid which can be supplied down one or more of the rigid conduits 23 extending alongside the riser. Additionally, a flow meter can be located within filter module 35 or base plate 33 for measuring hydraulic fluid flow through the system. A hydraulic regulator may be located within filter module 35 for stepping down supply pressure. In certain embodiments, filtered hydraulic fluid can flow from filter module 35 through module base plate 33 as a supply to all of the other hydraulically actuated equipment on both LMRP 19 and on BOP stack 13. One or more output lines 37, connected to an accumulator bank 38, leads to LMRP junction plate 29 for supplying hydraulic fluid pressure to the accumulators 95 of BOP stack 13. In certain embodiments, additional output lines 41 can be connected to the LMRP base receptacles 47 and to junction plates 29, 31 and further connect to the BOP base plates 69, supplying fluid to various modules 25.

Rigid conduit package 36 can be made up of subsea valve module 39, base plate 33 and filter module 35. In certain embodiments, a subsea valve module 39 can mount to module base plate 33 on both the Yellow System and the Blue System. Subsea valve module 39 can include a number of directional control valves, which are opened and closed by hydraulic pressure supplied by pilot valves that may be located in a control module 51. These directional control valves can be used for various functions, such as for example, isolation and flushing of the rigid conduits 23, filter selection, as well as valves for selection, isolation of pilot, and testing of hydraulic circuits. Module base plate 33 is connected by hydraulic fluid lines 37 and 41 to one of the junction plates 29. Subsea valve modules 39 are installable and retrievable by an ROV.

In certain embodiments, both the Yellow and Blue Systems are connected to shuttle valve module base plate 43 mounted to LMRP 19. One or more shuttle valve modules 45 can be retrievably mounted to each module base plate 43. The shuttle valves in shuttle valve modules 45 can be connected to valve actuators and other equipment, such as for example, annular BOP 17 or LMRP connector 19. Those functions can include connecting and disconnecting the connection between LMRP 19 and BOP stack 13, closing annular BOP 17 and operating other LMRP hydraulically controlled functions. The hydraulic lines leading to shuttle valve base plate 43 are not shown. Each shuttle valve base plate 43 can be connected to both the hydraulic fluid lines leading from control valves of the Yellow System and from control valves of the Blue System. Depending on whether the pressure is being delivered by the Yellow System or the Blue System, each shuttle valve can automatically shift to direct the hydraulic fluid pressure to the valve actuator, connector or other equipment. Each shuttle valve module 45 can receive fluid from either the Blue or the Yellow System and can direct the fluid to the designated component of LMRP 19. In certain embodiments, module base plates 43 and one or more shuttle valve modules 45 can include a shuttle valve package 40.

The Yellow and Blue Control Systems each have a control module base plate 47 mounted to LMRP 19. Each control module base plate 47 includes receptacles for one or more control modules. In certain embodiments, a regulator module 49 can be retrievably mounted to base plate 47. Regulator module 49 can include a number of hydraulic regulators that provide the means for regulating the system output pressure for the different hydraulic circuits for functions on LMRP 19. Preferably, in certain embodiments, each regulator is independently adjustable. In certain other embodiments, the solenoid pilot regulator can be a manual regulator that is preset at the surface, while the other regulators can be adjusted remotely subsea. Other configurations are also possible. Hydraulic fluid lines 57 supply hydraulic fluid pressure from rigid conduit base plate 33 to module 49.

One or more subsea control modules (SCM) 51 can be retrievably mounted to each control module base plate 47 of LMRP 19. The SCM can include a subsea electronic module (SEM) that can receive and decode multiplexed signals from the surface control unit. SCM 51 can include electronics as well as solenoid pilot valves and directional control valves. The electronics portion of each SCM 51 can be configured to receive communication signals from a surface control unit. The electronics portion can then decode the signals and convert them to hydraulic signals via electrically operated solenoid valves, which act as pilot valves for other elements such as hydraulically operated directional control valves. In certain embodiments, each SCM 51 is capable of controlling a number of hydraulic functions, either directly or as pilots to larger, high flow rate directional control valves. Some of those functions include housekeeping functions and others are control functions. Some of those functions can include, but are not limited to: operating the locking and unlocking of the connector of LMRP 19 to BOP stack 13; controlling the hydraulic regulators; and controlling various test valves and isolation valves on LMRP 19. Hydraulic pilot pressure from one of the SCMs 51 will also control directional control valves in subsea valve module 39 located in rigid conduit valve package 36.

In certain embodiments, a subsea valve module 55 also retrievably mounts to each module base plate 47. In certain embodiments, subsea valve module 55 can include high flow rate directional control valves for controlling some of the large functions on LMRP 19, such as the annular BOP 17 (FIG. 1), which is part of LMRP 19 in the figure. The directional control valves are operated via hydraulic pilot signals received from one of the SCM's 51. The fluid flow from subsea valve module 55 leads to shuttle valve module base plate 45, which direct the fluid to the particular function. In certain embodiments, LMRP control package 32 can include base plates 47 and modules 49, 51 and 55.

In certain embodiments, there can be two electrical cables 58, 60 extending from the drilling vessel. Each electrical cable 58, 60 independently supports power and communications to both the Yellow and Blue Systems. An electrical termination and connection assembly 59 (TCA) is located at the lower end of each electrical cable 58, 60. Each TCA 59 includes connections for power and communication, which can optionally include fiber optic lines. Each TCA 59 includes electrical lines 61, 63 leading from it for supplying power to the Yellow and Blue Systems, respectively. Line 61 of each TCA 59 leads to Yellow System control module base plate 47 for supplying power and communications to Yellow System SCMs 51. Line 63 of each TCA 59 leads to Blue System control module base plate 47 (FIG. 2B) for supplying power and communications to Blue System SCMs 51. In certain embodiments, each TCA 59 can provide one line 61 (Yellow) and one line 63 (Blue). Thus, in embodiments with two TCAs (one for control cable 58 and one for control cable 60), there are two independent and redundant power and communication connections feeding the Yellow System and likewise two independent and redundant power and communication connections feeding the Blue System. Other configurations are possible, and are within the scope of this invention.

The Yellow System can include an electrical line 65 that connects power and communications line 61 at control module base plate 47 and leads to junction plate 29 for delivering power and signals to the various Yellow System elements on BOP stack 13. The Blue System can include a similar electrical line 67 that connects power and communications of line 63 at control module base plate 47 and leads to junction plate 29 for delivering power and signals to the various Blue System elements on BOP stack 13. In certain embodiments, a mirror image of this configuration can connect to the redundant second set of power and communications signals from the other TCA 59 via base plates 47 to the other junction plate 29 to feed redundant power and communications signals to both the Yellow and Blue systems.

BOP stack 13 can include a Yellow System and a Blue System control module base plate 69. In certain embodiments, each base plate 69 can include multiple receptacles that receive, for example, a subsea valve module 71, one or more subsea control modules 73 and a regulator module 77. Subsea valve module 71 can include high flow rate directional control valves similar to subsea valve module 55. Subsea valve module 71 supplies hydraulic fluid pressure for BOP stack 13 functions such as opening and closing rams 15. SCMs 73 can include electronics along with pilot valves and directional control valves for controlling the various functions on BOP 13. These functions can include, for example, the various valves of BOP stack 13, connector to subsea wellhead, choke and kill valves, as well as housekeeping functions, such as for example, increasing and decreasing hydraulic fluid pressure controlled by regulators in the regulator module 77.

Regulator module 77, similar to LMRP regulator module 49, regulates the hydraulic fluid pressure for the hydraulic functions on BOP stack 13, rather than the hydraulic functions on LMRP 19. SCMs 73 control regulator module 77 to change the hydraulic fluid pressure for the various rams 15 as well as the connector to subsea wellhead 11 (FIG. 1). Various hydraulic lines 79 lead from junction plate 31 to module base plate 69 for receiving hydraulic fluid pressure from rigid conduit base plate 33. In certain embodiments, BOP control package 34 can include base plates 69 and modules 71, 73 and 77.

Electrical line 65 of junction plate 29 can supply electrical power and communication signals from electrical cable 58 to Yellow System SCMs 73 via electrical line 81, which extends from BOP stack junction plate 31. Electrical line 67, also of junction plate 29, supplies electrical power and communication signals from electrical cable 58 to Blue System SCM's 73 via electrical lines 83, which extends from BOP stack junction plate 31. A mirror image of this electrical connection arrangement provides redundant power and communications signals via the opposite junction plate set 29 and 31, to the BOP stack SCMs 73 on both the Yellow and Blue Systems. In the event of failure of one electrical cable 58 or 60, the other electrical cable 58 or 60 will supply all electrical power and communication signals to either the Yellow or Blue System, as needed.

BOP stack 13 includes a subsea module base plate 85 having receptacles adapted to receive shuttle valve modules 87, which in turn are connected to various hydraulically actuated equipment, such as for example, pipe rams 15 (FIG. 1). In certain embodiments, the shuttle valve modules 87 can be part of the shuttle valve package 40.

A parking base plate 91 may optionally be mounted to BOP stack 13 or LMRP 19. Parking base plate 91 preferably can include parking receptacles 93 adapted to receive any one of the modules 25. In certain embodiments, an ROV would be able bring down a replacement module 25 and temporarily park it in one receptacle 93 in order to disconnect one of the other modules 25. The ROV could then place the recently removed module 25 in the other parking receptacle 93, pick up the replacement module and install it in one of the base plates. The ROV would then pick up the removed module from the receptacle 93 and retrieve it to the surface. BOP stack 13 also has a set of accumulators 95 that are supplied with hydraulic fluid through hydraulic line 97 leading from junction plate 31.

During certain operations, the various modules 25 (FIG. 1) on LMRP 19 perform functions associated with LMRP 19 and also provide filtration for all of the hydraulic systems, including those of BOP stack 13. The various modules 25 of BOP stack 13 can be directed to the functions of BOP stack 13. In certain embodiments, to connect BOP stack 13 to subsea wellhead 11 using the Yellow System, communication signals will be sent down one of the electrical lines 58 through lines 61, 65 and 81 to one of the BOP stack subsea control modules 73. That control signal will cause a pilot valve or a directional control valve to send hydraulic fluid pressure to subsea valve module 71, which in turn supplies hydraulic fluid pressure to the connector via one of the shuttle valves in one of the shuttle valve modules 87. If a function is required of LMRP 19 and the Yellow system is in use, the signal can be sent via electrical line 58 or 60 to one of the SCMs 51 of the Yellow System, which in turn can cause the hydraulic function to be performed through its pilot valves and/or directional control valves or through subsea valve module 55, via one of the shuttle valves in one of the shuttle valve modules 45.

In certain embodiments, when because of a storm or some other emergency, the vessel must be quickly moved, the operator may close rams 15 and disconnect LMRP 19 from BOP stack 13. The operator would then be able to leave the location with riser 21 and LMRP 19 trailing behind. The various rams 15 would remain closed as no hydraulic pressure would exist to cause them to open. When returning, if due to damage, LMRP 19 cannot connect back to BOP stack 13, the operator may be able to perform certain functions with BOP stack 13 without LMRP 19. The operator would be able to do this by connecting electrical power and hydraulic power via an umbilical and flying lead to the receptacles in BOP stack junction plate 31. That umbilical would supply hydraulic fluid pressure and signals directly from the vessel to either the Yellow or Blue System control modules 73 and to modules 71, 77 and accumulators 95. The operator could then open and close rams 15 and perform other functions interfacing with SCMs 73 or other modules.

In certain embodiments, the modules can be employed in retrofit applications. For example, in certain embodiments, the modules described herein can be employed on existing LMRP or BOP stack apparatuses to replace all or a portion of the control devices associated with said LMRP or BOP stack.

Although the following detailed description contains many specific details for purposes of illustration, one of ordinary skill in the art will appreciate that many variations and alterations to the following details are within the scope of the invention. Accordingly, the exemplary embodiments of the invention described below are set forth without any loss of generality to, and without imposing limitations thereon, the claimed invention.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

This application is related to U.S. Provisional Patent Application No. 60/955,085, entitled "Control System for Blowout Preventer Stack", filed on Aug. 10, 2007, and U.S. Provisional Patent Application No. 60/954,919, entitled "Control Module for Subsea Equipment", filed on Aug. 9, 2007, each of which are incorporated herein by reference in their entirety.

Throughout this application, where patents or publications are referenced, the disclosures of these references in their entireties are intended to be incorporated by reference into this application, in order to more fully describe the state of the art to which the invention pertains, except when these reference contradict the statements made herein.

What is claimed is:

1. A subsea blowout preventer assembly, said assembly including a lower marine riser package (LMRP) and a blowout preventer stack (BPS), wherein said LMRP comprises a first junction plate and said BPS comprises a second junction plate, and junction plates coupled with each other and connecting at least one of the hydraulic, electrical or communications signals from the surface to said assembly, said assembly comprising:

a plurality of LMRP module baseplates positioned on said LMRP;

a plurality of LMRP modules configured to control electrical or hydraulic functionality associated with said LMRP, each of said LMRP modules being releasably connected to a separate one of the plurality of LMRP module baseplates;

wherein at least one of said LMRP module baseplates further carries a plurality of separately positioned auxiliary LMRP modules selected from the group consisting of a subsea regulator module, subsea valve module, subsea filter modules, subsea accessory module, chemical injection module, subsea shuttle valve module, subsea acoustic system module, subsea pressure transducer module and subsea temperature transducer module;

at least one BPS module baseplate positioned on said BPS; and at least one BPS control module configured to control electrical or hydraulic functionality associated with said BPS, said BPS module being releasably connected to the BPS module baseplate;

wherein said LMRP and BPS modules are configured to be installed and retrieved by a remotely operated vehicle.

2. The assembly of claim 1 wherein said overall system is redundant, wherein the at least two LMRP control modules are present on said LMRP and at least two of said BPS control modules are present on said BPS, forming redundant assembly control modules.

3. The assembly of claim 2 wherein said redundant LMRP modules do not function cooperatively and said redundant BPS modules do not function cooperatively.

4. The assembly of claim 1 wherein a single hydraulic line supplies the modules on both the LMRP and the BPS.

5. The assembly of claim 1 wherein at least one of the LMRP module baseplates further carries a subsea valve module, said subsea valve module comprising at least one directional control valve configured for isolation and flushing of rigid conduits, filter selection and valve selection for the isolation of pilot valves and testing of hydraulic circuits.

6. The assembly of claim 1 wherein at least one of the LMRP module baseplates further carries a regulator module configured to regulate system output pressure for the hydraulic circuits on the lower marine riser package.

7. The assembly of claim 1 wherein at least one of the LMRP control modules is configured to receive communication signals from a surface control unit and convert said signals to hydraulic signals.

8. A subsea blowout preventer assembly, said assembly including a lower marine riser package (LMRP) and a blowout preventer stack (BPS), wherein said LMRP comprises a first junction plate and said BPS comprises a second junction plate, and junction plates coupled with each other and connecting at least one of the hydraulic, electrical or communications signals from the surface to said assembly, said assembly comprising:

a plurality of LMRP module baseplates positioned on said LMRP;

a plurality of LMRP modules configured to control electrical or hydraulic functionality associated with said LMRP, each of said LMRP modules being releasably connected to a separate one of the plurality of LMRP module baseplates;

at least one BPS module baseplate positioned on said BPS; and at least one BPS control module configured to control electrical or hydraulic functionality associated with said BPS, said BPS module being releasably connected to the BPS module baseplate;

wherein said BPS module baseplate further carries a plurality of separately positioned auxiliary BPS modules selected from the group consisting of a subsea regulator module, subsea valve module, subsea filter module, subsea accessory module, chemical injection module, subsea shuttle valve module, subsea acoustic system module, subsea pressure transducer module and subsea temperature transducer module; and wherein said LMRP and BPS modules are configured to be installed and retrieved by a remotely operated vehicle.

9. The assembly of claim 8 wherein said assembly is redundant, wherein at least two LMRP control modules are present on said LMRP and at least two of said BPS control modules are present on said BPS, forming redundant assembly control modules.

10. The assembly of claim 9 wherein said redundant LMRP modules do not function cooperatively and said redundant BPS modules do not function cooperatively.

11. The assembly of claim 8 wherein a single hydraulic line supplies the modules on both the LMRP and the BPS.

12. The assembly of claim 8 wherein at least one of the LMRP module baseplates further carries a subsea valve module, said subsea valve module comprising at least one directional control valve configured for isolation and flushing of rigid conduits, filter selection and valve selection for the isolation of pilot valves and testing of hydraulic circuits.

13. The assembly of claim 8 wherein at least one of the LMRP module baseplates further carries a regulator module configured to regulate system output pressure for the hydraulic circuits on the lower marine riser package.

14. The assembly of claim 8 wherein at least one of the LMRP control modules is configured to receive communication signals from the surface control unit and convert said signals to hydraulic signals.

15. The assembly of claim 8 further comprising a parking base plate positioned on the LMRP, said parking base plate comprising at least two parking receptacles adapted to receive any of a plurality of modules comprising LMRP or BPS control modules and a plurality of different LMRP or BPS auxiliary modules.

16. The assembly of claim 8 further comprising a parking base plate positioned on the BPS, said parking base plate comprising of at least two parking receptacles adapted to receive any of a plurality of modules comprising LMRP or BPS control modules and a plurality of different LMRP or BPS auxiliary modules.

17. A subsea blowout preventer assembly, said assembly including a lower marine riser package (LMRP) and a blowout preventer stack (BPS), wherein said LMRP comprises a first junction plate and said BPS comprises a second junction plate, said junction plates connecting at least one of hydraulic, electrical or communications signals from the surface to said assembly, said assembly comprising:

at least one LMRP module baseplate positioned on said LMRP, the module baseplate carrying a filter module, said filter module comprising high flow rate filters designed to provide local filtration of fluid which can be supplied down at least one rigid conduit extending along a riser;

at least one LMRP control module configured to control electrical or hydraulic functionality associated with said LMRP, said LMRP module being releasably connected to the LMRP module baseplate;

at least one BPS module baseplate positioned on said BPS; and at least one BPS control module configured to control electrical or hydraulic functionality associated with said BPS, said BPS module being releasably connected to the BPS module baseplate;

wherein said LMRP and BPS modules are configured to be installed and retrieved by a remotely operated vehicle.

18. A subsea blowout preventer assembly, said assembly including a lower marine riser package (LMRP) and a blowout preventer stack (BPS), wherein said LMRP comprises a first junction plate and said BPS comprises a second junction plate, and junction plates coupled with each other and connecting at least one of the hydraulic, electrical or communications signals from the surface to said assembly, said assembly comprising:

a plurality of LMRP module baseplates positioned on said LMRP;

a plurality of LMRP modules configured to control electrical or hydraulic functionality associated with said LMRP, each of said LMRP modules being releasably connected to a separate one of the plurality of LMRP module baseplates;

at least one BPS module baseplate positioned on said BPS;

at least one BPS control module configured to control electrical or hydraulic functionality associated with said BPS, said BPS module being releasably connected to the BPS module baseplate; and a parking base plate positioned on the LMRP, said parking base plate comprising at least two parking receptacles adapted to receive any of a plurality of modules comprising LMRP or BPS control modules and a plurality of different LMRP or BPS auxiliary modules;

wherein said LMRP and BPS modules are configured to be installed and retrieved by a remotely operated vehicle.

19. A subsea blowout preventer assembly, said assembly including a lower marine riser package (LMRP) and a blowout preventer stack (BPS), wherein said LMRP comprises a first junction plate and said BPS comprises a second junction plate, and junction plates coupled with each other and connecting at least one of the hydraulic, electrical or communications signals from the surface to said assembly, said assembly comprising:

a plurality of LMRP module baseplates positioned on said LMRP;

a plurality of LMRP modules configured to control electrical or hydraulic functionality associated with said LMRP, each of said LMRP modules being releasably connected to a separate one of the plurality of LMRP module baseplates;

at least one BPS module baseplate positioned on said BPS;

at least one BPS control module configured to control electrical or hydraulic functionality associated with said BPS, said BPS module being releasably connected to the BPS module baseplate; and a parking base plate positioned on the BPS, said parking base plate comprising of at least two parking receptacles adapted to receive any of a plurality of modules comprising LMRP or BPS control modules and a plurality of different LMRP or BPS auxiliary modules;

wherein said LMRP and BPS modules are configured to be installed and retrieved by a remotely operated vehicle.

20. A subsea blowout preventer assembly, said assembly including a lower marine riser package (LMRP) and a blowout preventer stack (BPS), wherein said LMRP comprises a first junction plate and said BPS comprises a second junction plate, said junction plates coupled with each other and connecting at least one of hydraulic, electrical or communications signals from the surface to said assembly, said assembly comprising:

a plurality of LMRP module baseplates positioned on said LMRP;

a plurality of LMRP control modules configured to control electrical or hydraulic functionality associated with said LMRP, each of said LMRP modules being releasably connected to a separate one of the plurality of LMRP module baseplates;

a plurality of separately positioned auxiliary LMRP modules selected from the group consisting of a subsea regulator module, subsea valve module, subsea filter module, subsea accessory module, subsea shuttle valve module, subsea acoustic system module, subsea pressure transducer module and subsea temperature transducer module;

a plurality of BPS module baseplates positioned on said BPS;

a plurality of BPS control modules configured to control electrical or hydraulic functionality associated with said BPS, each of said BPS modules being releasably connected to a separate one of the plurality of BPS module baseplates; and a plurality of separately positioned auxiliary BPS modules selected from the group consisting of a subsea regulator module, subsea valve module, subsea filter module, subsea accessory module, subsea shuttle valve module, subsea acoustic system module, subsea pressure transducer module and subsea temperature transducer module;

wherein said LMRP modules and said BPS modules are configured to be installed and retrieved by a remotely operated vehicle.

21. A method for controlling a subsea blowout preventer assembly, said assembly including a lower marine riser package (LMRP) and a blowout preventer stack (BPS), wherein said LMRP comprises a first junction plate and said BPS comprises a second junction plate, wherein said LMRP and said BPS are coupled at said first and second junction plate, said junction plates connecting at least one of hydraulic, electrical or communications signals from the surface to said assembly, said method comprising:

providing a plurality of LMRP module baseplates positioned on said LMRP;

providing a plurality of LMRP control modules configured to control electrical or hydraulic functionality associated with said LMRP, each of said LMRP modules being releasably connected to a separate one of the plurality of LMRP module baseplates;

providing a plurality of auxiliary LMRP modules, each being selected from the group consisting of a subsea regulator module, subsea valve module, subsea filter module, subsea accessory module, subsea shuttle valve module, subsea acoustic system module, subsea pressure transducer module and subsea temperature transducer module, said plurality of auxiliary LMRP modules being releasably connected to one of the plurality of LMRP module baseplates;

providing a plurality of BPS module baseplates positioned on said BPS;

providing a plurality of BPS control modules configured to control electrical or hydraulic functionality associated with said BPS, each of said BPS modules being releasably connected to a separate one of the plurality of BPS module baseplate's; and providing a plurality of auxiliary BPS modules, each being selected from the group consisting of a subsea regulator module, subsea valve module, subsea filter module, subsea accessory module, subsea shuttle valve module, subsea acoustic system module, subsea pressure transducer module and subsea temperature transducer module, said plurality of auxiliary BPS modules being releasably connected to one of the plurality of BPS module baseplates; and installing or removing at least one module selected from the group consisting of the LMRP control module, the LMRP auxiliary module, the BPS control module, and the BPS auxiliary module with a remotely operated vehicle.

22. A method for replacing a module on a subsea blowout preventer assembly, said blowout preventer stack comprising a lower marine riser package (LMRP) and a blowout preventer stack (BPS), said LMRP comprising at least one LMRP module baseplate and said BPS comprising at least one BPS module baseplate, said LMRP module baseplate being configured to receive at least one LMRP module and said BPS module baseplate being configured to receive at least one BPS module, said LMRP and said BPS each comprising at least one parking receptacle, the method comprising:

using a remotely operated vehicle (ROV) to transport at least one replacement module from the surface to a module baseplate;

positioning said replacement module in a first parking receptacle, said first parking receptacle being adapted to receive a module;

utilizing said ROV to remove at least one module from either the LMRP module baseplate or said BPS module baseplate, thereby creating an empty position in said module baseplate;

utilizing said ROV to position said removed module in a second parking receptacle, said second parking receptacle being adapted to receive a module;

utilizing said ROV to retrieve said replacement module from said first parking receptacle and position said replacement module into the empty position in the module baseplate.

* * * * *